US005345224A

United States Patent [19]

Brown

[11] Patent Number: 5,345,224

[45] Date of Patent: Sep. 6, 1994

[54] LEAK DETECTION AND MANAGEMENT APPARATUS INCLUDING A PROGRAMMABLE MESSAGE DEVICE FOR A HOT WATER HEATER

[76] Inventors: Jimmy D. Brown, 8621 Hartwell, Detroit, Mich. 48228

[21] Appl. No.: 874,300

[22] Filed: Apr. 24, 1992

[51] Int. Cl.[5] ..... G08B 21/00; 340 603; 340 604; 340 605; 340 616; 340 618; 340 623; 340 624; 340 625; 340 691; 200 61.04; 200 84 R; 137 551; 137 558; 73 40; 73 305; 73 307; 73 317; 73 319

[52] U.S. Cl. ..... 340/605; 340/616; 340/623; 73/40

[56] References Cited

U.S. PATENT DOCUMENTS

| | | | |
|---|---|---|---|
| 3,063,432 | 11/1962 | Bond et al. . | |
| 3,069,671 | 12/1962 | Taylor | 340/616 |
| 3,473,553 | 10/1969 | Collins . | |
| 3,770,002 | 11/1973 | Brown | 200/61.05 X |
| 3,920,031 | 11/1975 | Maxfield . | |
| 4,283,657 | 8/1981 | Gordon et al. | 340/691 X |
| 4,324,268 | 4/1982 | Jacobson | 340/620 X |
| 4,805,662 | 2/1989 | Moody | 200/61.04 X |
| 4,814,752 | 3/1989 | Lehman | 340/623 X |
| 4,909,274 | 5/1990 | Rodriguez . | |
| 4,944,253 | 7/1990 | Bellofatto . | |
| 5,029,605 | 7/1991 | Dowling et al. | 200/61.05 X |

*Primary Examiner*—Jeffery A. Hofsass
*Attorney, Agent, or Firm*—Harness, Dickey & Pierce

[57] ABSTRACT

A leak detection and management apparatus including a programmable message device, for a hot water heater. The apparatus includes a liquid pan disposed beneath and concentrically with a hot water heater for collecting water leaking from the hot water heater. A float is disposed at least partially within the liquid pan 14 and causes an electrical shut-off signal from an electrical switch to be generated when it is elevated in response to the collection of water within the liquid pan 14. The electrical shut-off signal causes electrically controlled solenoid valves disposed in the water supply and gas lines to the hot water heater 12 to be closed, thereby interrupting the flow of cold water and natural gas into the hot water heater 12, and simultaneously causing a programmable message device to play a prerecorded message informing of the water leak and where to obtain service to correct same. In a preferred embodiment, the programmable message device includes a conventional magnetic tape transport device having a magnetic recording medium such as a cassette tape and a conventional speaker. The magnetic recording medium includes a preprogrammed message which may be made by personnel installing the apparatus.

8 Claims, 1 Drawing Sheet

LEAK DETECTION AND MANAGEMENT APPARATUS INCLUDING A PROGRAMMABLE MESSAGE DEVICE FOR A HOT WATER HEATER

BACKGROUND OF THE INVENTION

1. Technical Field

This invention is related to leak detection systems for hot water heaters, and more particularly to a leak detection and management system including a programmable message device for providing an audible message informing of the occurrence of a water leak in a hot water heater and where to obtain service for correcting the leaking condition of the hot water heater.

2. Discussion

Hot water heaters are used in a wide variety of applications, and particularly in residential homes to provide hot water for washing and bathing. Such hot water heaters typically include a relatively large tubular hot water tank, a cold water supply conduit for supplying cold water into the tank, a gas supply line for supplying natural gas or the like to a heating unit disposed within the tank which operates to heat the cold water supplied to the tank, and a conduit leading out of the hot water tank for supplying the heated water to various areas of a home or other like dwelling.

Since the volume of water which can be held within the hot water tank is substantial, even a small leak in the tank, or in a temperature and pressure relief valve which is typically included with such hot water heaters, can cause significant damage and expense to property, if undetected quickly. Prior art systems attempting to manage water leaks occurring in hot water heaters have suffered from a number of drawbacks. Principally, these drawbacks have centered around the inability of such prior art devices to provide adequate warning and notice to home owners or other occupants of the dwelling that a water leak condition has occurred, and where to obtain service for the hot water heater. Prior art systems attempting to address this problem have furthermore been of relatively complex designs often necessitating significant additional complexity and significant additional cost to implement.

Accordingly, it would be highly desirable to provide a leak detection and management system including some means for providing an audible warning message to a home owner or other occupant, in addition to a message as to where service can be obtained, which can be easily integrated with conventional hot water heaters to notify occupants of dwellings that a leak in a hot water heater has occurred.

Such a system as described above would immediately apprise occupants that a water leak has occurred, and would further enable such occupants to immediately contact qualified and trained service personnel, thereby minimizing the inconvenience associated with the repair of the hot water heater. This would significantly reduce the inconvenience to occupants by insuring that occupants would be notified of a water leak immediately upon the occurrence of same, and thus be able to contact service personnel quickly.

It is therefore a principal object of the present invention to provide a water leak detection and management apparatus having a programmable message device for providing an audible message that a water leak has occurred with a hot water heater and where to obtain service for same.

It is yet a further object of the present invention to provide a water leak detection and management apparatus, including a programmable message device, which apparatus can be easily connected with virtually all conventional hot water heaters presently in production, with no modification to the hot water heater itself and minimal modification to its corresponding water and gas supply lines.

It is still a further object of the present invention to provide a water leak detection and management apparatus including a programmable message device, where the programmable message device includes a magnetic recording medium such as a cassette tape, which can easily and quickly be preprogrammed to provide a suitable warning message informing of a water leak condition and where to obtain service for same.

It is yet another object of the present invention to provide a water leak detection and management apparatus including a programmable message device, where the apparatus is relatively inexpensive to construct and install, and utilizes well known, commercially available components in its construction.

It is still another object of the present invention to provide a water leak detection and management apparatus including a programmable message device, which apparatus is operable to collect water leaking from a hot water heater and to drain the water to either a nearby drain such as a floor drain, or to a remotely located drain, or simultaneously to both the nearby and remotely located drains, to thereby enable the collection and draining of large amounts of water leaked from a hot water heater during a catastrophic leak situation.

SUMMARY OF THE INVENTION

The above and other objects are provided by water leak detection and management apparatus including a programmable message device, for a hot water heater, in accordance with the preferred embodiments of the present invention. The apparatus generally includes a liquid pan disposed underneath the hot water heater having a diameter sufficient to substantially circumscribe the entire outer periphery of the hot water heater, a float disposed at least partially within the liquid pan for providing a mechanical signal indicative of the collection of a predetermined amount of water within the pan, and thus a leak condition, a first electrical switch associated with the float for providing an electrical shut-off signal when the water level within the liquid pan has reached the predetermined level, a first flow interrupting device disposed in a cold water supply line of the hot water heater and responsive to the electrical shut-off signal for interrupting the flow of cold water into the water heater in response to generation of the electrical shut-off signal, a second flow interrupting device disposed in the gas supply line of the hot water heater for interrupting the flow of gas to the hot water heater in response to the generation of the electrical shut-off signal, and a programmable message device for generating a pre-programmed audible message for informing an occupant that a water leak has occurred with the hot water heater and where to obtain service for same, in response to the generation of the electrical shut-off signal. In the preferred embodiment, the programmable message device comprises a conventional magnetic tape player and magnetic tape medium. The magnetic tape medium may be programmed by service personnel installing the apparatus so that occupants and/or other individuals may be informed of the appropriate service personnel to contact by the audible warning message.

In one preferred embodiment the apparatus further comprises an overflow aperture disposed in a side wall of the liquid pan near an upper surface of the liquid pan, and a conduit in communication with the overflow aperture for enabling fluid which rises to the level of the overflow aperture to be drained through the conduit to a nearby floor drain or other like drainage means. A secondary overflow aperture may also be included in the side wall of the liquid pan, in addition to a secondary overflow reservoir in communication with the secondary overflow aperture. The secondary overflow aperture enables fluid which rises to the level of the secondary overflow aperture to flow into the secondary overflow reservoir. A pump may be optionally installed within the secondary overflow reservoir to enable the liquid contents therein to be pumped to a remotely located drain.

The various embodiments of the invention may be implemented with the use of inexpensive and readily commercially available components. The preferred embodiments are further energy efficient in that they require no electricity or other energy to monitor for water leaks. Only when a leak has occurred is electrical energy required to cause the flow interrupting devices and the programmable message device to become operational.

DETAILED DESCRIPTION OF THE PREFERRED EMBODIMENTS

Figure 1:
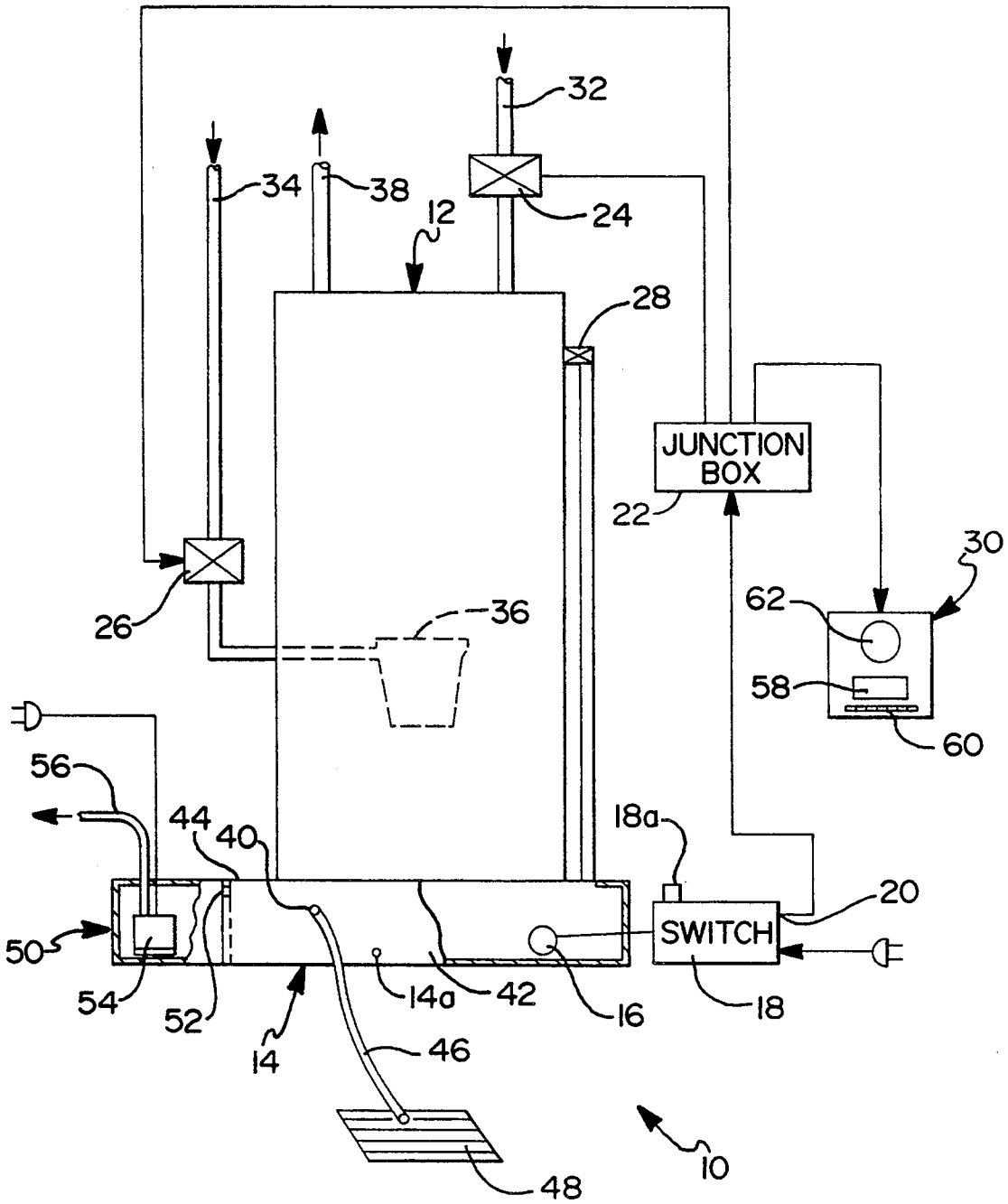
FIG. 1 is a schematic diagram of a leak detection and management apparatus including a programmable message device for a hot water heater, in accordance with the preferred embodiments of the present invention, showing and a liquid pan of the apparatus drawn in fragmentary fashion to illustrate a float disposed therein, and showing the apparatus installed in connection with a conventional hot water heater, and also showing an optional secondary overflow reservoir and optional pump for the secondary overflow reservoir.

Referring to FIG. 1, there is shown a leak detection and management system 10 including a programmable message device for a hot water heater 12. The apparatus 10 generally comprises a circular liquid pan 14 disposed beneath the hot water heater 12 and having a diameter sufficient to at least substantially circumscribe the entire periphery of the hot water heater 12, and a float 16 disposed at least partially within the liquid pan 14 for generating a mechanical signal to an electrical switch 18 indicative of the collection of water of a predetermined amount within the liquid pan 14. The liquid pan may be comprised of a wide variety of suitable materials such as plastic or metal. Switch 18 may represent a conventional boiler switch.

The electrical switch 18 includes an output 20 which is coupled to a conventional electrical junction box 22, which is in turn electrically coupled to a first electrically controlled solenoid valve 24, a second electrically controlled solenoid valve 26, and a programmable message device 30. The first solenoid valve 24 is preferably disposed in-line in a cold water supply conduit 32 which supplies cold water to the hot water heater 12. The second solenoid valve 26 is preferably located in-line with a gas supply conduit 34 which supplies natural gas or the like to a conventional, thermostatically controlled gas valve 36 within the hot water heater 12. A hot water discharge line 38 enables hot water to be withdrawn from the hot water heater 12.

The liquid pan 14 further optionally comprises an overflow aperture 40 in a side wall portion 42 thereof. The overflow aperture 40 is further disposed near an upper surface 44 of the liquid pan 14. A conduit 46 is in communication with the overflow aperture 40 and preferably leads to a nearby floor drain 48. Conduit 46 is preferably composed of a clear plastic tube to also enable quick visual identification of water passing therethrough. The ability to quickly visually identify water flowing through conduit 46 serves the purpose of providing an early warning function for water heaters that are installed in remote areas, such as above drop ceilings in commercial buildings. In such instances, where water is visually noted to be passing through conduit 46 by, for example, an occupant of the building, the occupant may quickly notify building maintenance personnel of the occurrence of the leak, even though the occupant is not within hearing range of the programmable message device 30.

Optionally, the apparatus 10 may also include a secondary overflow reservoir 50 which forms a semi-circular liquid pan disposed immediately adjacent the side wall 42 of liquid pan 14 and which is in communication with a secondary overflow aperture 52 in the side wall 42 of the liquid pan 14 at a position closer to the upper surface 44 than the overflow aperture 40. The secondary overflow reservoir 50 may take a wide variety of shapes but preferably includes at least a semi-circular portion having a radius of curvature similar to the radius of curvature of the liquid pan 14, to thereby enable the secondary overflow reservoir 50 to fit closely adjacent the side wall 42 of the liquid pan 14. Still further, an optional, conventional, AC powered (i.e., 110 VAC) electric pump 54 may be disposed within the secondary overflow reservoir and coupled with a discharge conduit 56 leading to a remotely located drain to provide a means for draining the secondary overflow reservoir in installations where a nearby drain such as drain 48 is not conveniently accessible or completely absent.

In operation, when a water leak occurs in the hot water heater 12, or from a conventional temperature and pressure relief valve 28 associated with typical hot water heaters, the water drains down into the liquid pan 14 and is collected therein. At this point the float 16 rises a predetermined distance, thereby providing a mechanical signal which triggers electrical switch 18. Electrical current from an AC current source, or alternatively a DC battery, is then supplied through the switch 18 and forms an electrical shut-off signal which is transmitted to the electrical junction box 22. The electrical junction box 22 simultaneously sends the electrical shut-off signal to the first and second solenoid valves 24 and 26, respectively, and the programmable message device 30. In the preferred embodiment the programmable message device 30 includes a conventional magnetic tape transport device including a magnetic recording medium 58, preferably in the form of a cassette tape or the like, and may also optionally include basic controls 60 to implement "rewind", "stop", "play" and other like functions. It will be appreciated, however, that any suitable means for generating an audible message such as programmable solid-state devices may be employed in lieu of a conventional tape transport device.

The electrical shut-off signals sent to the first and second valves 24 and 26 and the programmable message device 30 simultaneously causes the first and second solenoid valves 24 and 26 to interrupt the flow of cold water and gas, respectively, into the hot water heater 12, and also simultaneously to cause a prerecorded message on the recording medium 58 to begin playing through a speaker 62 of the device 30. The speaker may alternatively be disposed remotely of the apparatus 10 by suitable conductors, such as in a kitchen or other highly used room of a dwelling. The preprogrammed message informs an occupant of the house or dwelling that a water leak has occurred and where to call for appropriate service. The message preferably plays continuously until the owner or service personnel, via controls 60, stops the playing of the message. The message may be prerecorded by qualified service personnel installing the apparatus 10.

Accordingly, the apparatus 10 operates to quickly provide a clear audible message that a water leak has occurred and to promptly inform occupants of the malfunction and where to obtain qualified service to correct the malfunction. This is a significant advantage in that occupants are immediately informed of the malfunction, and can be provided with the name and number of qualified service personnel able and equipped to correct the malfunction.

The apparatus 10 further provides the advantage of preventing the flow of gas and cold water into the hot water heater 12, thereby also saving gas and water. Since many leaks in hot water heaters occur while occupants are away, the apparatus 10 can provide significant cost savings by immediately interrupting the supply of cold water and gas to a leaking hot water heater.

The switch 18 may further comprise an optional "override" button **18*a* or like, manually settable implement for causing switch 18 to remain open in spite of the presence of water in the liquid pan 14. This would be useful in situations where only a very slight leak exists in the hot water heater 12 and it is desired to continue using the hot water heater 12 until service personnel can arrive to repair or replace the hot water heater 12. The liquid pan 14 is further coupled to the float 16 in any suitable manner to enable the pan 14 to be detached therefrom, or the pan 14 and float 16 to be detached as a unit from switch 18, to thus enable the contents of the pan 14 to be easily emptied during repair or replacement of the hot water heater 12. Alternatively, an optional drain plug 14*a* may be disposed in the side wall 42 near the very bottom of the side wall 42 to enable the pan 14** to be drained completely.

As mentioned previously herein, the secondary overflow reservoir 50 may optionally be included in the apparatus 10 to provide a secondary means for collecting water which accumulates too rapidly within the liquid pan 14 to be drained therefrom by overflow aperture 40. Accordingly, when a catastrophic leak occurs, if water collects within liquid pan 14 too quickly to be drained therethrough by overflow aperture 40, water within the liquid pan 14 drains through the secondary overflow aperture 52 into the secondary overflow reservoir 50. Since the secondary overflow aperture 52 is positioned at a height above the overflow aperture 40, water typically will not flow into reservoir 50, and aperture 40 will in almost all circumstances be able to handle any overflow condition occurring. However, when the collection of water within liquid pan 14 is so rapid as to cause the water level to quickly rise to the secondary overflow aperture 52, water drains therethrough and may be pumped out of reservoir 50 by optional pump 54 to a remotely located drain via conduit 56 or, alternatively, to an available nearby drain such as drain 48. It should also be noted that pump 54 only becomes operational when a predetermined amount of water accumulates in the secondary overflow reservoir 50. Until this time pump 54 remains "off" and draws no current. Pump 54 is preferably powered by a 110 VAC power source and may comprise a pump like widely commercially employed sump pumps. Thus, it will be appreciated that pump 54 employs its own water detection apparatus such as a float. The addition of the secondary overflow reservoir 50 and pump 54 thereby forms a secondary means for controlling any possible overflow from the liquid pan 14.

The components of the apparatus 10 are relatively inexpensive and widely commercially available, and require no modification to typical hot water heaters and minimal modification to their fluid and gas supply lines.

It should also be appreciated that the solenoid valves 24 and 26 are preferably normally open valves which do not interrupt or otherwise affect the flow of cold water and gas into the hot water heater 12 at times when no water leak is occurring. Thus, the apparatus 10 does not consume any energy when the hot water heater 12 is operating normally with no leaks.

Also, while the apparatus has been described as an addition to be retrofitted to existing hot water heaters, it will be appreciated that the apparatus 10 could easily be manufactured and integrally assembled as part of a new hot water heater before installation of the hot water heater.

Those skilled in the art can now appreciated from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claims is:

1. An apparatus for detecting and managing water leaks in a hot water heater, said apparatus comprising:

pan means for collecting water leaking from said hot water heater, said pan means being disposed generally concentrically underneath said hot water heater and circumscribing substantially the entire periphery of said water heater;

float means disposed within said pan means and responsive to a water level in said pan means for providing a mechanical signal when said water level in said pan means rises to a predetermined level;

first electrical switch means responsive to said mechanical signal generated by said float means for providing an electrical shut-off signal when said float means rises to a predetermined level within said pan means;

a first electrically controlled valve disposed in a cold water supply line of said water heater responsive to said electrical shut-off signal for controllably interrupting the flow of cold water into said hot water heater in response to said electrical shut-off signal;

a second electrically controlled valve disposed in a gas supply line for said water heater for interrupting a flow of gas to said water heater in response to said electrical shut-off signal;

means for providing a programmable audio message in response to said electrical shut-off signal to thereby notify an occupant of a dwelling where said hot water heater is disposed that a water leak has occurred;

said pan means including an overflow aperture located near an upper end thereof;

a conduit coupled to said overflow aperture leading to a drain, said overflow aperture and said conduit enabling a portion of leaking water within said pan means to be drained therefrom to help prevent an overflow of said pan means;

a secondary overflow reservoir;

a secondary overflow aperture in communication with said secondary overflow reservoir, said secondary overflow reservoir being operable to receive an overflow of water collected within said pan means; and pump means disposed within said secondary overflow reservoir and responsive to the collection of a predetermined amount of water in said secondary overflow reservoir for pumping water collected within said secondary overflow reservoir to a drain.

2. A leak detection and management apparatus including a programmable message device, for detecting and managing leaks occurring in a hot water heater and providing an audible message to a person informing that a leak has occurred and where to call for service, said apparatus comprising:

a liquid pan disposed concentrically beneath said hot water heater and being of a diameter and shape sufficient to circumscribe substantially the entire outer periphery of said hot water heater, for collecting water leaking from said hot water heater;

a float disposed at least partially within said liquid pan and operable to rise and descent in response to rising and descending water levels within said liquid pan;

an electrical switch operably associated with said float for generating an electrical shut-off signal when said water collected within said liquid pan causes said float to rise to a predetermined level;

a first electrically controlled solenoid valve responsive to said electrical shut-off signal and disposed in a cold water supply line of said hot water heater for interrupting a flow of cold water into said hot water heater in response to said electrical shut-off signal;

a second electrically controlled solenoid valve disposed in a gas supply line to said hot water heater for interrupting the flow of gas into said hot water heater in response to said electrical shut-off signal; and a programmable magnetic tape message device operable to provide a continuous, pre-programmed audible message in response to the generation of said electrical shut-off signal to thereby audibly inform individuals that a leak in said hot water has occurred and where to obtain service for said hot water heater;

wherein said liquid pan includes an overflow aperture mounted in a side wall portion thereof near an upper surface thereof;

a secondary overflow aperture disposed in said side wall at a position closer to said upper surface than said overflow aperture; and a secondary overflow reservoir in communication with said secondary overflow aperture for collecting water therewithin which flows through said secondary overflow aperture.

3. The apparatus of claim 2, wherein said liquid pan includes an overflow aperture disposed in a side wall portion thereof near an upper surface thereof; and a conduit in communication with said overflow aperture, said conduit and said overflow aperture enabling water collected within said liquid pan which has risen to the level of said overflow aperture to be transported through said conduit to an adjacent floor drain.

4. The apparatus of claim 2, wherein said programmable message device comprises a magnetic tape player and a magnetic tape medium, said magnetic tape medium being magnetically encoded with a predetermined message advising that a water leak has occurred and where to obtain service for said water heater, said magnetic tape player being responsive to said electrical shut-off signal and operable to play continuously in response to said electrical shut-off signal.

5. The apparatus of claim 3, wherein said conduit is comprised of clear plastic tubing to enable visual detection that water is passing therethrough.

6. The apparatus of claim 2, wherein said secondary overflow reservoir includes a pump responsive to the accumulation of water within said secondary overflow reservoir for pumping water collected within said secondary overflow reservoir to a remotely located drain.

7. The apparatus of claim 6, wherein said electrical shut-off signal operates to simultaneously to cause said first and second electrically controlled solenoid valves to interrupt the flow of said cold water and said gas, respectively, to said hot water heater, and to simultaneously initiate operation of said programmable message device.

8. A water leak detection and management system including a programmable message device for informing of the occurrence of a water leak in a hot water heater and where to obtain service, said apparatus comprising:

a liquid pan adapted to be disposed beneath said hot water heater and being of a sufficient diameter so as to circumscribe substantially completely the periphery of said hot water heater for collecting water leaking from said hot water heater;

said liquid pan having an overflow aperture located in a side wall portion thereof near an upper surface thereof;

a conduit in communication with said overflow aperture for conveying water passing through said overflow aperture to a nearby drain;

a secondary overflow aperture disposed in said side wall at a position closer to said upper surface than said overflow aperture for draining water from said liquid pan which rises to the level of said secondary overflow aperture;

a secondary overflow reservoir in communication with said secondary overflow aperture for collecting water passing through said secondary overflow aperture;

a float disposed within said liquid pan and adapted to rise and descend in response to rising and descending water levels within said pan, to thereby provide a mechanical signal indicative of a water leak condition occurring with said hot water heater when water leaking from said hot water heater collects within said liquid pan;

an electrical switch associated with said float for providing an electrical shut-off signal in response to movement of said float to a predetermined position;

a first electrically controlled solenoid valve disposed in a cold water supply line of said hot water heater and responsive to said electrical shut-off signal for interrupting a flow of cold water into said hot water heater when said electrical shut-off signal is generated;

a second electrically controlled solenoid valve disposed in a gas supply line of said hot water heater for interrupting a flow of gas to said hot water heater in response to the generation of said electrical shut-off signal;

a programmable message device responsive to said electrical shut-off signal for generating a preprogrammed audio message in response to the generation of said electrical shut-off signal informing of the occurrence of a water leak in said hot water heater and where to obtain service; and a pump disposed within said secondary overflow reservoir and responsive to the collection of water within said secondary overflow reservoir for pumping water collected within said secondary overflow reservoir to a remote drain.

* * * * *